US006422936B1

(12) United States Patent
Van Gilst et al.

(10) Patent No.: US 6,422,936 B1
(45) Date of Patent: Jul. 23, 2002

(54) BUILDING-ATTACHED ORNAMENT OR VENTILATOR

(75) Inventors: Carl W. Van Gilst, Goshen, IN (US); Glen R. George, St. Johns, MI (US)

(73) Assignee: Behlen Engineered Plastics, Goshen, IN (US)

( * ) Notice: Subject to any disclaimer, the term of this patent is extended or adjusted under 35 U.S.C. 154(b) by 0 days.

(21) Appl. No.: 09/836,827

(22) Filed: Apr. 17, 2001

(51) Int. Cl.[7] ..... F24F 13/20
(52) U.S. Cl. ..... 454/367; 52/200; 454/365
(58) Field of Search ..... 454/367, 365; 52/199, 200; 362/145, 312, 316, 315

(56) References Cited

U.S. PATENT DOCUMENTS 1,976,032 A * 10/1934 Morton ..... 52/200
3,338,006 A * 8/1967 Belden ..... 52/200
4,136,474 A * 1/1979 Belokin, Jr. ..... 40/559
4,204,271 A * 5/1980 Braly ..... 362/145
4,888,923 A * 12/1989 Post, Jr. ..... 52/200
5,245,804 A * 9/1993 Schiedegger et al. ..... 52/199
5,345,369 A * 9/1994 Ruud et al. ..... 362/145
5,347,776 A * 9/1994 Skoff ..... 52/219
5,483,428 A * 1/1996 Poppenheimer ..... 362/101

* cited by examiner

*Primary Examiner*—Harold Joyce
*Assistant Examiner*—Derek S. Boles
(74) *Attorney, Agent, or Firm*—Wendell E. Miller

(57) ABSTRACT

A building ornament, building ventilator, roof ventilator, or cupola (10 or 50), includes a top portion (12 or 52), a base portion (14 or 54), one portion (12, 14, 52, or 54) preferably is translucent. Optionally, the cupola (10 or 50) includes an illumination unit (82), elongated ventilation slots (32, 74), a plastic screen (76), to exclude bugs, that preferably is welded into one of the portions (52 or 54), and multiple V-shaped flanges (92A, 92B, or 92C) of different pitches that provide means for attachment to double-pitched roofs (42) having different pitches (40A, 40B, or 40C).

26 Claims, 3 Drawing Sheets

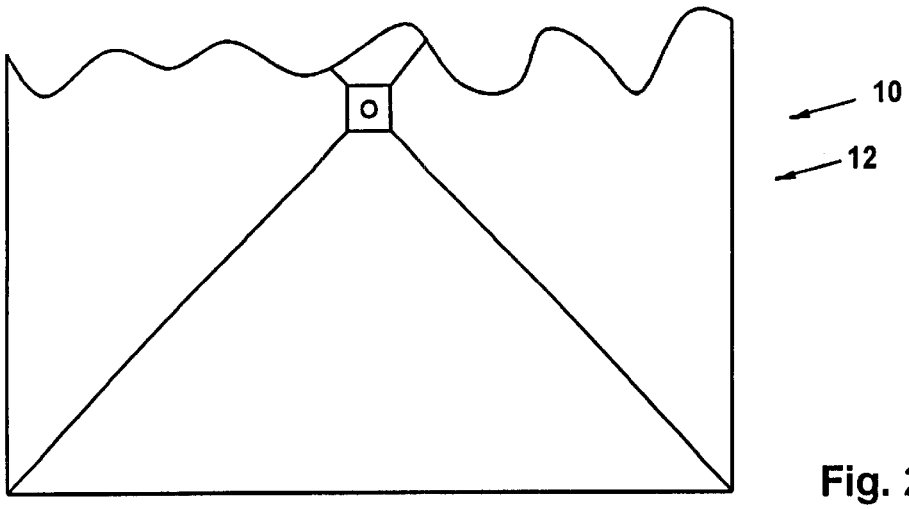
Fig. 2
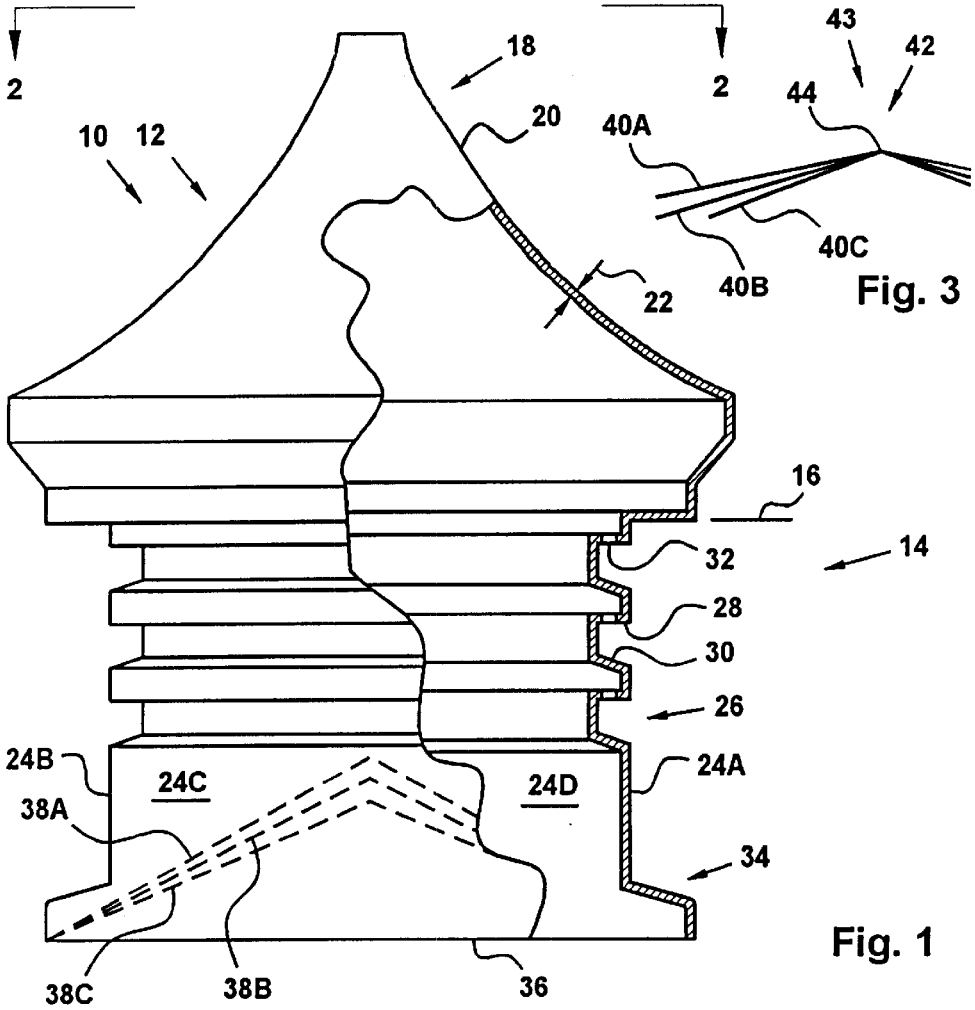
Fig. 3
Fig. 1

BUILDING-ATTACHED ORNAMENT OR VENTILATOR

CROSS-REFERENCE TO RELATED APPLICATIONS

None.

SEQUENCE LISTING

Not Applicable.

BACKGROUND OF THE INVENTION

1. Field of the Invention

The present invention relates generally to apparatus for attachment to a building. More particularly, the present invention relates to a building ornament, building ventilator, roof ventilator, or cupola.

2. Description of the Related Art

Cupolas are placed on top of buildings for ornamentation, and often they are used also for ventilation. Most cupolas have been individually crafted from wood, making them expensive. Further, being fabricated from wood, they have been expensive to maintain.

Manufactured units, fabricated from sheet metal, have been available. While having a cost advantage over individually-crafted units of wood, they have been expensive to manufacture due to the number of individual pieces that must be formed and then fastened together.

Additional disadvantages of cupolas made from sheet metal include the fact that they are easily damaged in shipping, and after installation, they are susceptible to damage from hail and falling tree limbs.

BRIEF SUMMARY OF THE INVENTION

A building ornament or building ventilator is provided for permanently attaching to, and incorporation into, pitched roofs as an integral part of homes or other buildings. In a preferred form, the ornament or ventilator is a cupola. The cupola includes a top portion that preferably is in the form of a four-sided pyramid, and a four-sided base portion. Preferably, whatever form the present invention takes, at least a portion is made of a translucent plastic, and an illumination unit is enclosed inside.

For attaching to double-pitched roofs with various pitches, two embodiments are provided. In a preferred embodiment, pairs of spaced-apart flanges are integrally molded to the base portion, with steeper pitched pairs of the flanges being disposed closer to the housing. By cutting off one or more pairs of flanges, the building ornament or ventilator is adapted to different pitches of roofs.

In an other embodiment, guide lines, that may be either raised or depressed, are molded onto the base portion to provide a cutting guide for various roof pitches.

Optionally, ventilation slots are provided, and bugs are kept out by plastic screens that are plastic welded inside the housing. The two portions are separately or integrally molded by either rotation molding or blow molding.

In a first aspect of the present invention, a building ornament for incorporation into a roof of a building that is part of an estate as an integral part of the building comprises: a molded-plastic base portion that circumscribes an enclosed area of the roof; a molded-plastic top portion that substantially covers the enclosed area, and that is operatively attached to the base portion; an illumination unit that is disposed inside the building ornament and is operatively attached to one of the portions; one of the portions is translucent; and means for permanently attaching the base portion to the roof.

In a second aspect of the present invention, a ventilator for incorporation into a roof of a building as an integral part thereof comprises: a molded-plastic housing having a chamber that opens downwardly through the ventilator; means for allowing air to flow from the chamber to an atmosphere; a portion of the ventilator is translucent; and the ventilator further comprises an illumination unit being disposed inside the housing.

BRIEF DESCRIPTION OF THE SEVERAL VIEWS OF THE DRAWINGS

FIG. 1 is an end elevation of an embodiment of a rotomolded, or blow molded, ventilator, ornament, or cupola of the present invention in which a top portion and a base portion thereof are molded integrally, showing trim lines for cutting sides to conform to a selected one of three different roof pitches, with a portion broken away to show construction details;

FIG. 2 is a partial top view of the cupola of FIG. 1, taken substantially as shown by view line 2—2 of FIG. 1, with a portion broken away;

FIG. 3 is an end elevation illustrating a peak of a roof and three different roof pitches;

DETAILED DESCRIPTION OF THE INVENTION

Figure 4:
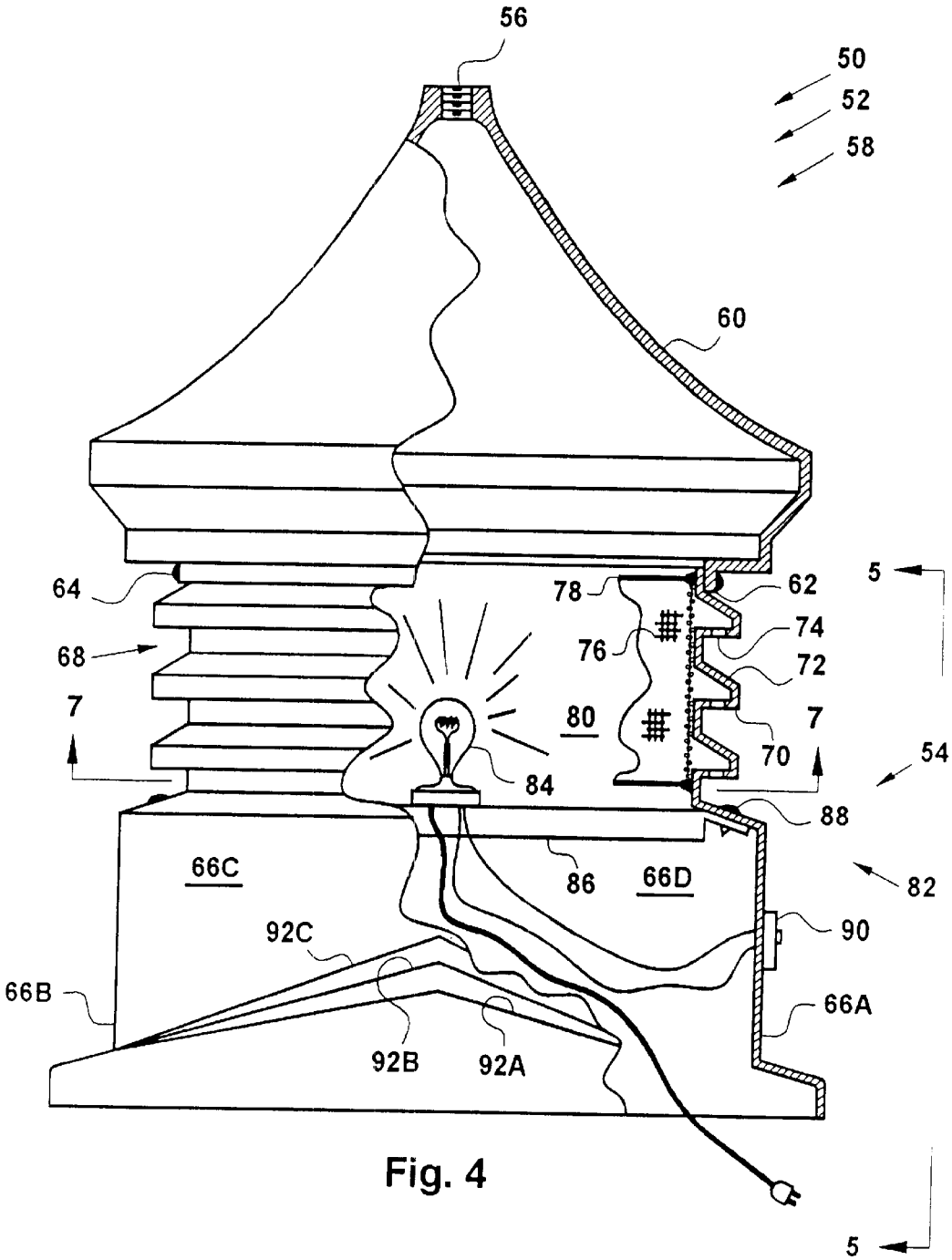
FIG. 4 is an end elevation of an embodiment of a cupola that is made in two parts, a top portion and a base portion, showing attachment of the two by a self-tapping screw, with a portion broken away to show a plastic screen and an illumination unit.

Referring now to FIGS. 1 and 2, a building ornament, ventilator, building ventilator, roof ventilator, or cupola 10 includes a top portion 12 and a base portion, bottom portion, or housing, 14 that are molded integrally.

The top portion 12 and the base portion 14 are herein distinguished by a line 16, with the top portion 12 being disposed above the line 16. As shown in FIG. 1, the top portion 12 covers, and extends outwardly over, the base portion 14.

The top portion 12 is square, or rectangular, as shown in FIG. 2, and the top portion 12 is generally in the form of a four-sided pyramid 18 with four concave sides 20. Both the top portion 12 and the base portion 14 include wall thicknesses 22.

The base portion 14 is generally rectangular, or square, with four sides, or walls, 24A, 24B, 24C, and 24D. Each of the four sides 24A–24D, includes a plurality of grooves 26.

Each of the grooves 26 includes an upper wall 28 and a lower wall 30, and each of the upper walls 28 includes an elongated ventilation slot 32. Since the upper walls 28 are substantially horizontal, they provide means for protecting the elongated ventilation slots 32 from rain.

The base portion 14 includes flanges 34 that extend outward from the walls 24A and 24B, but the walls 24C and 24D do not include the flanges 34. Instead the walls 24C and 24D extend downward to a bottom 36 of the base portion 14.

Guide lines 38A, 38B, and 38C are molded, either raised or sunken, to the walls 24C and 24D, but are shown only on the wall 24C. The guide lines 38A, 38B, and 38C provide a ready guide for cutting the cupola 10 to match one of different roof pitches 40A, 40B, or 40C of FIG. 3 of a double-pitched roof 42 of a building 43 having a peak 44.

Figure 6C:
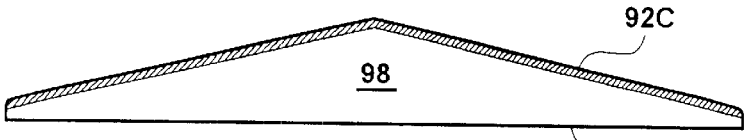
FIG. 6C is a cross-section taken substantially as shown by section line 6C—6C of FIG. 5.
Figure 6B:
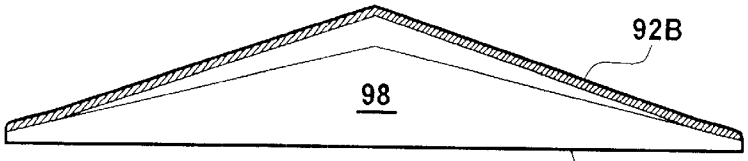
FIG. 6B is a cross-section taken substantially as shown by section line 6B—6B of FIG. 5.
Figure 6A:
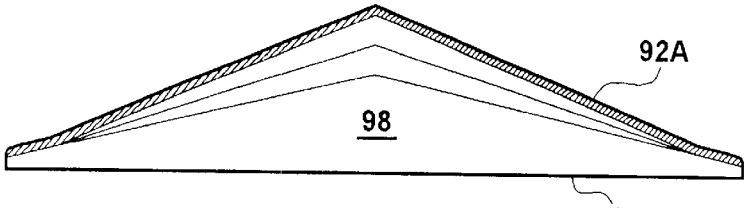
FIG. 6A is a cross-section taken substantially as shown by section line 6A—6A of FIG. 5.

Although not shown in FIGS. 1 and 2, the cupola 10 may include any or all features as will be described in conjunction with FIGS. 4–6, except that the top portion 12 and the base portion 14 are molded integrally.

Referring now to FIG. 4, a building ornament, ventilator, building ventilator, roof ventilator, or cupola 50 includes a top portion 52 and a bottom portion, base portion, or housing, 54 that are separately molded.

Preferably, a threaded-metal insert 56 is molded into the top portion 52. The threaded insert 56 may be used to attach any of various articles or devices, such as a weather vane, a flag, or an antenna.

The top portion 52 of FIG. 4 is generally rectangular, in like manner to the top portion 12 of the cupola 10, as shown in FIG. 2, and is generally in the shape of a four-sided rectangular pyramid 58 with four concave walls 60, as described for the top portion 12 of FIG. 1. In addition, the top portion 52 includes an attaching flange 62 though which attaching screws 64 engage the base portion 54.

Figure 7:
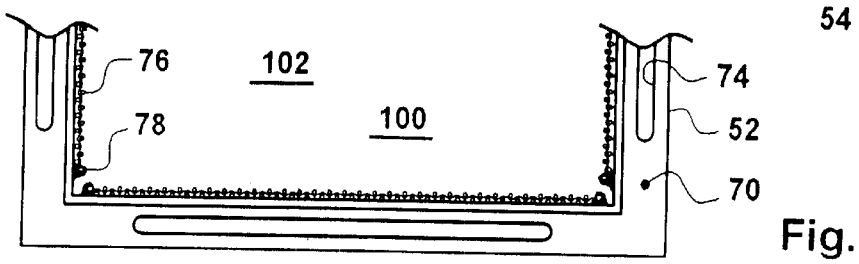
FIG. 7 is a partial cross-section taken substantially as shown by section line 7—7 of FIG. 4.

The base portion 54 includes four walls, 66A, 66B, 66C, and 66D, all of which include grooves 68 with upper walls 70, lower walls 72, and elongated ventilation slots 74, as also shown in FIG. 7.

Referring now to FIGS. 4 and 7, a plastic screen 76 is disposed inside the base portion 54, is generally juxtaposed against the walls, 66A–66D, and is plastic welded to the walls, 66A–66D by plastic-weld beads 78. Thus, the screen 76 provides means for excluding bugs from an interior or chamber, 80 of the base portion 54.

Referring again to FIG. 4, an illumination unit 82 includes a lamp and socket 84, a mounting bar 86 that is attached to the base portion 54 by screws 88, and a photoelectric switch 90 that is attached to the base portion 54 by any suitable means.

Figure 5:
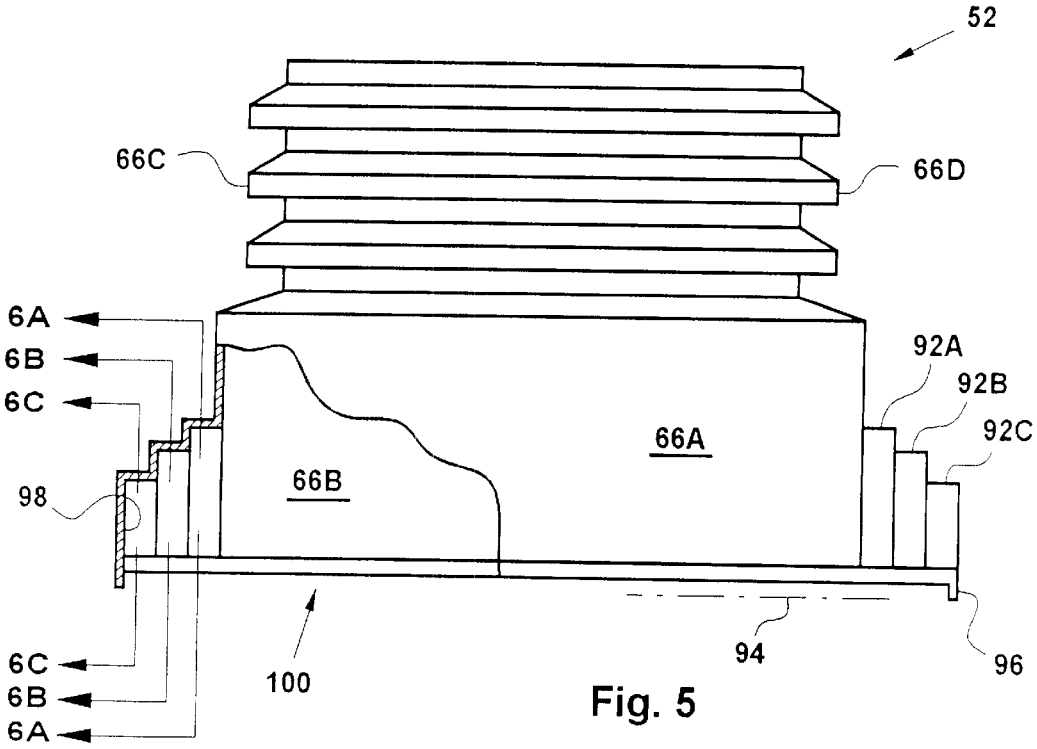
FIG. 5 is a front elevation of the base portion of the cupola of FIG. 4, taken substantially as shown by view line 5—5 of FIG. 4, showing a portion broken away to show a plurality of V-shaped flanges for adapting to a selected one of a plurality of roof pitches.

Referring now to FIGS. 4, 5, 6A, 6B, and 6C, and more particularly to FIG. 5, the base portion 54 includes pairs of V-shaped flanges 92A, 92B, and 92C that are molded integrally on opposite sides of the base portion 54.

The pair of V-shaped flanges, 92A, that have the steepest pitches, are molded to respective ones of the walls 66C and 66D, the pair of V-shaped flanges 92B, that have smaller pitches, are molded to respective ones of the flanges 92A, and the pair of flanges 92C, that have the smallest pitches, are molded to respective ones of the flanges 92B.

Referring now to FIGS. 5, 6A, 6B, and 6C, as rotary or blow molded, the base portion 54 includes a bottom 94, as shown by a partial phantom line. When the bottom 94 is removed, it may leave lips 96, which are extensions downward of ends 98 of the flanges 92C. However, when the base portion 54 is cut along any cutting plane, 6A, 6B, or 6C, the ends 98, together with the lips 96, are removed.

Thus, the flanges 92A, 92B, and 92C provide means for attaching the cupola 50 to the roof 42 of FIG. 3 straddling the peak 44 thereof, and for mounting the cupola 50 to differently pitched roofs, 40A, 40B, and 40C of FIG. 3 straddling the peak 44, by cutting along one of the cutting planes, 6A, 6B, or 6C.

Cutting along the cutting plane 6C removes the ends 98. Cutting along the cutting plane 6B removes the flanges 92C. Cutting along the cutting plane 6A removes the flanges 92C and 92B, thereby leaving the flanges 92A to engage the steepest pitch 40C of the roof 42 of FIG. 3. Referring again to FIG. 5, the base portion 54 of the cupola 50 includes an open bottom 100 having an enclosed area 102, as shown in FIG. 7. The chamber 80 opens through the open bottom 100 to the roof 42 of FIG. 3.

Thus, air can be vented from the roof 42 of FIG. 43, air can flow from the enclosed area 102 and the chamber 80 to atmosphere outside the cupola 50, and air can flow through the cupola 50 by flowing into one of the elongated ventilation slots 74, and flowing out of an other of the elongated ventilation slots 74.

Referring again to FIG. 4, the top portion 52 covers the enclosed area 102 of the base portion 54, thereby closing the chamber 80.

Preferably, one of the portions, 52 or 54 is molded from a translucent plastic. Optionally, the portions 52 and 54 are molded from different colors of plastics, or one is molded from a dark-pigmented, or opaque, plastic.

In summary, the present invention provides an ornament, a ventilator, a building ventilator, a roof ventilator, and/or a cupola 10 or 50, that includes a portion, 12, 14, 52, or 54, molded from a translucent plastic, and that optionally includes the illumination unit 82. The present invention also provides guide lines, 38A, 38B, and 38C for fitting the ventilator or cupola 10 to roofs 42 having different pitches, 40A, 40B, and 40C.

Finally, the cupola 50 includes V-shaped flanges, 92A, 92B, and 92C, for fitting double-pitched roofs 42, straddling the peak 44 thereof, and for fitting different pitches, 40A, 40B, and 40C of the roof 42 by removing the ends 98, by removing the V-shaped flanges 92C, or by removing the V-shaped flanges 92C and 92B.

While specific apparatus and method have been disclosed in the preceding description, and while numbers have been inserted into the claims parenthetically, it should be understood that these specifics have been given for the purpose of disclosing the principles of the present invention, and that many variations thereof will become apparent to those who are versed in the art. Therefore, the scope of the present invention is to be determined by claims included herein without any limitation by numbers parenthetically inserted in the claims.

What is claimed is:

1. A building ornament (10 or 50) for incorporation into a roof (42) of a building (43) that is part of an estate as an integral part of said building which comprises:

a molded-plastic base portion (14 or 54) that circumscribes an enclosed area (102) of said roof;

a molded-plastic top portion (12 or 52) that substantially covers said enclosed area, and that is operatively attached to said base portion;

an illumination unit (82) that is disposed inside said building ornament and is operatively attached to one of said portions;

one of said portions is translucent; and means for permanently attaching said base portion to said roof.

2. A building ornament (50) as claimed in claim 1 in which said base portion (54) comprises a dark-pigmented plastic.

3. A building ornament (10 or 50) as claimed in claim 1 in which said building ornament includes means (32 or 74) for allowing air to flow through said building ornament.

4. A building ornament (50) as claimed in claim 1 in which:

one of said portions includes an elongated ventilation slot (32 or 74); and said building ornament further comprises a screen being disposed over said elongated ventilation slot, and being plastic welded to said one portion.

5. A building ornament (10) as claimed in claim 1 in which said operative attaching of said top portion (12) to said base portion (14) comprises integrally molding said top portion and said base portion.

6. A building ornament (10) as claimed in claim 1 in which said base portion (14) includes means, comprising a plurality of differently pitched guide lines (38A, 38B, 38C) that are molded on opposite walls (24C or 24D) of said base portion, for guidance in selectively cutting said base portion to fit a selected pitch (40A, 40B, 40C) of double-pitched roofs (42) having different pitches.

7. A building ornament (50) as claimed in claim 1 in which:

said building ornament includes means, comprising a plurality of pairs of differently-pitched V-shaped flanges (92A, 92B, 92C) that are molded integrally with said base portion (54), with higher pitched pairs of said V-shaped flanges being disposed proximal to said base portion, for fitting said building ornament to a selected pitch (40A, 40B, 40C) of double-pitched roofs (42) having different pitches; and said means for permanently attaching comprises said flanges.

8. A building ornament (50) as claimed in claim 1 in which said building ornament further comprises:

means (74) for allowing air to flow through one of said portions (52 or 54);

means, comprising a plurality of pairs of differently-pitched V-shaped flanges (92A, 92B, 92C) that are molded integrally with said base portion, with higher pitched pairs of said V-shaped flanges being disposed proximal to said base portion, for fitting said building ornament to a selected pitch (40A, 40B, 40C) of double-pitched roofs (42) having different pitches; and said means for permanently attaching comprises said flanges.

9. A building ornament (50) as claimed in claim 1 in which:

one of said portions (54) includes an elongated ventilation slot (74);

said building ornament further comprises a screen (76) being disposed over said elongated ventilation slot;

means, comprising a plurality of pairs of differently-pitched V-shaped flanges (92A, 92B, 92C) that are molded integrally with said base portion, with higher pitched pairs of said V-shaped flanges being disposed proximal to said base portion, for fitting said building ornament to a selected pitch (40A, 40B, 40C) of double-pitched roofs (42) having different pitches; and said means for permanently attaching comprises said flanges.

10. A ventilator (50) for incorporation into a roof (42) of a building (43) as an integral part thereof which comprises:

a molded-plastic housing (54) having a chamber (80) that opens downwardly through said ventilator;

means (74) for allowing air to flow from said chamber to an atmosphere;

a portion (52 or 54) of said ventilator is translucent; and said ventilator further comprises an illumination unit (82) being disposed inside said housing.

11. A ventilator (50) as claimed in claim 10 in which:

said means for allowing air to flow from said chamber (80) comprises an elongated ventilation slot (74); and said ventilator further comprises a plastic screen (76) covering said elongated ventilation slot and being plastic welded to said ventilator.

12. A ventilator (50) as claimed in claim 10 in which:

said ventilator comprises means for mounting to a double-pitched roof (42) straddling a peak (44) thereof; and said means for mounting to said double-pitched roof comprises a plurality of pairs of differently-pitched V-shaped flanges (92A, 92B, 92C) that are molded integrally with said housing (54), with higher pitched pairs of said V-shaped flanges being disposed proximal to said housing, for fitting said ventilator to a selected pitch (40A, 40B, 40C) of double-pitched roofs having different pitches.

13. A ventilator (50) as claimed in claim 10 in which:

said ventilator comprises means for mounting to a double-pitched roof (42) straddling a peak (44) thereof;

said means for allowing air to flow from said chamber (80) comprises an elongated ventilation slot (74);

said ventilator further comprises a plastic screen (76) covering said elongated ventilation slot and being plastic welded to said ventilator; and said means for mounting to said double-pitched roof comprises a plurality of pairs of differently-pitched V-shaped flanges (92A, 92B, 92C) that are molded integrally with said housing (54), with higher pitched pairs of said V-shaped flanges being disposed proximal to said housing, for fitting said ventilator to a selected pitch (40A, 40B, 40C) of double-pitched roofs having different pitches.

14. A ventilator (50) for attaching to pitched roofs of buildings straddling a peak (44) thereof which comprises:

a molded-plastic housing (54) having a chamber (80) that opens to a roof (42);

means (74) for allowing air to flow from said chamber to an atmosphere;

means, comprising a first pair of spaced-apart V-shaped flanges (92A) that are disposed outwardly from said chamber on opposite sides thereof, and that are molded integrally with said housing, for fitting said ventilator to a selected one of two roofs having different pitches; and said means for fitting said ventilator to a second of said two roof pitches comprises a second pair of spaced-apart V-shaped flanges (92B) that are disposed outwardly from the first said pair of spaced-apart V-shaped flanges and that are molded integrally with respective ones of said first pair of V-shaped flanges.

15. A ventilator (50) as claimed in claim 14 in which:

said ventilator comprises a portion (52 or 54) that is translucent; and said ventilator further comprises an illumination unit (82) that is disposed inside said housing (54).

16. A ventilator (50) as claimed in claim 14 in which:

said ventilator comprises a portion (52 or 54) that is translucent;

said ventilator further comprises an illumination unit (82) that is disposed inside said ventilator;

said means for allowing air to flow from said chamber (80) comprises an elongated ventilation slot (74); and said ventilator further comprises a plastic screen (76) covering said elongated ventilation slot and being plastic welded to said ventilator.

17. A cupola (50) which comprises:

an integrally-molded plastic top portion (52) that is shaped as a rectangular pyramid with concave sides (20);

an integrally molded plastic base portion (54) that has four walls (66A, 66B, 66C, 66D) and that is rectangular;

means, comprising a pair of first V-shaped flanges (92A) that are integrally molded to opposite ones of said walls, for mounting to a double-pitched roof (42) straddling a peak (44) thereof; and means, comprising an other pair of V-shaped flanges (92B) that are integrally molded to respective ones of the first said V-shaped flanges, for mounting to said double-pitched roof having a different pitch (40A, 40B, 40C).

18. A cupola (50) as claimed in claim 17 in which:

one of said portions (52 or 54) of said cupola is translucent; and said cupola includes an illumination unit (82) that is disposed in said cupola.

19. A cupola (50) as claimed in claim 17 in which:

one of said portions (52 or 54) of said cupola is translucent;

said cupola includes an illumination unit (82) that is disposed in said cupola;

one of said walls (66A, 66B, 66C, 66D) includes an elongated ventilation slot (74);

said cupola comprises means (70) for sheltering said elongated ventilation slot from rain; and said cupola further comprises means (76) for preventing bugs from entering said cupola through said slot.

20. A cupola (50) as claimed in claim 17 in which:

one of said portions (52 or 54) of said cupola is translucent;

said cupola includes an illumination unit (82) that is disposed in said cupola;

one of said walls (66A, 66B, 66C, 66D) includes an elongated ventilation slot (74);

said cupola comprises means (70) for sheltering said elongated ventilation slot from rain;

a plastic screen (76) is disposed inside said base portion (54) and is plastic welded to said base portion; and a threaded-metal insert (56) is molded into said top portion (52).

21. A cupola (50) for mounting at a peak (44) of a pitched roof (42) which comprises:

a top portion (52) that is shaped generally as a rectangular pyramid (58);

a base portion (54) that has four walls (66A, 66B, 66C, 66D) and that is rectangular, and means for mounting said cupola to said roof;

one of said portions is translucent; and an illumination unit (82) is disposed inside said cupola.

22. A cupola (50) as claimed in claim 21 in which said base portion (54) is generally opaque.

23. A cupola (50) as claimed in claim 21 in which:

said base portion (54) comprises an integrally-molded base portion;

said cupola comprises means for attaching said cupola to said roof (42) having one of two pitches;

said means for attaching said cupola to said roof having one of said pitches comprises a first pair of spaced-apart V-shaped flanges (92A) that are disposed outwardly from said base portion and that are molded integrally with said base portion;

said means for attaching said cupola to said roof having the other of said pitches comprises a second pair of spaced-apart V-shaped flanges (92B) that are disposed outwardly from the first said pair of spaced-apart V-shaped flanges; and that are molded integrally with respective ones of V-shaped flanges;

one of said walls (66A, 66B, 66C, 66D) includes an elongated ventilation slot (74);

said cupola includes means (70) for sheltering said elongated ventilation slot from rain; and said cupola includes means (76), being disposed inside said base portion and being plastic welded thereto, for preventing bugs from entering said cupola through said elongated ventilation slot.

24. A method for attaching a molded-plastic housing (54) to a selected one of a plurality of differently-pitched roofs (42) straddling a peak (44) thereof which comprises:

a) integrally molding a first pair of V-shaped flanges (92A) with a first pitch proximal to opposite sides of said housing;

b) integrally molding a second pair of V-shaped flanges (92B) with a shallower pitch to respective ones of said first V-shaped flanges, distal from said housing; and c) removing a portion of both flanges of a selected one of said pairs of V-shaped flanges, whereby remaining portions of said flanges of said selected pair will engage a roof with a selected pitch.

25. A cupola (50) as claimed in claim 21 in which:

said base portion comprises an integrally-molded base portion (54);

said cupola comprises means (92A, 92B, or 92C) for attaching said cupola to a roof (42) having one of two pitches;

said means for attaching said cupola to a roof having one of said pitches comprises a first pair of spaced-apart V-shaped flanges (92A) that are disposed outwardly from opposite sides of said base portion and that are molded integrally with said base portion; and said means for attaching said cupola to a roof having the other of said pitches comprises a second pair of spaced-apart V-shaped flanges (92B) that are disposed outwardly from respective ones of the first said pair of spaced-apart V-shaped flanges and that are molded integrally with said first pair of spaced-apart V-shaped flanges.

26. A method as claimed in claim 24 in which said method further comprises:

a) making said housing translucent; and b) inserting an illumination unit (82) into said housing.

* * * * *